US008085829B2

(12) United States Patent
Johansson et al.

(10) Patent No.: US 8,085,829 B2
(45) Date of Patent: Dec. 27, 2011

(54) FURNACE INSULATION

(75) Inventors: Lars Goran Johansson, Hallstahammar (SE); Lars-Henrik Eklund, Hallstahammar (SE)

(73) Assignee: Sandvik Intellectual Property AB, Sandviken (SE)

( * ) Notice: Subject to any disclaimer, the term of this patent is extended or adjusted under 35 U.S.C. 154(b) by 677 days.

(21) Appl. No.: 11/662,644

(22) PCT Filed: Aug. 31, 2005

(86) PCT No.: PCT/SE2005/001254
§ 371 (c)(1),
(2), (4) Date: Mar. 13, 2007

(87) PCT Pub. No.: WO2006/031166
PCT Pub. Date: Mar. 23, 2006

(65) Prior Publication Data

US 2008/0196641 A1 Aug. 21, 2008

(30) Foreign Application Priority Data

Sep. 16, 2004 (SE) ..... 0402228

(51) Int. Cl.
*H05B 3/66* (2006.01)
*H05B 3/06* (2006.01)
*F27D 1/00* (2006.01)

(52) U.S. Cl. ..... 373/130; 219/542; 432/251

(58) Field of Classification Search ..... 373/130, 373/137, 122; 110/336, 338, 340; 219/536, 219/539, 410, 542; 432/119, 248, 251, 252, 432/245
See application file for complete search history.

(56) References Cited

U.S. PATENT DOCUMENTS

| | | | | |
|---|---|---|---|---|
| 3,849,240 | A * | 11/1974 | Mikulak | 428/346 |
| 3,865,599 | A * | 2/1975 | Mansmann et al. | 501/95.1 |
| 3,879,167 | A | 4/1975 | De Luca et al. | |
| 2,831,151 | A | 1/1980 | Bulten-Kanthal | |
| 4,222,337 | A | 9/1980 | Christiansen | |
| 4,244,761 | A | 1/1981 | Remi et al. | |
| 4,553,246 | A | 11/1985 | Christie | |
| 4,677,731 | A | 7/1987 | Sommerer et al. | |
| 4,838,968 | A * | 6/1989 | Nelson | 156/64 |
| 5,229,576 | A | 7/1993 | Nakao et al. | |
| 5,896,410 | A | 4/1999 | Nguyen et al. | |
| 6,807,220 | B1 * | 10/2004 | Peck | 373/128 |
| 2005/0082281 | A1 * | 4/2005 | Uemori et al. | 219/539 |

FOREIGN PATENT DOCUMENTS

EP 2831151 1/1980

* cited by examiner

*Primary Examiner* — Henry Yuen
*Assistant Examiner* — Hung D Nguyen
(74) *Attorney, Agent, or Firm* — Young & Thompson

(57) ABSTRACT

A furnace insulation including fiber modules in the form of at least two cylinder segments (2, 3; 7, 8) that are placed against one another so as to form a cylinder whose internal volume constitutes the furnace space and that are adapted to allow an electrical resistance element (5) to lie against and be fastened in the inner surface (4) of the cylinder. The furnace insulation is characterized in that the inner part of the cylinder includes one or more radially extending or generally radially extending openings (12; 14).

20 Claims, 5 Drawing Sheets

FURNACE INSULATION

Figure 1:
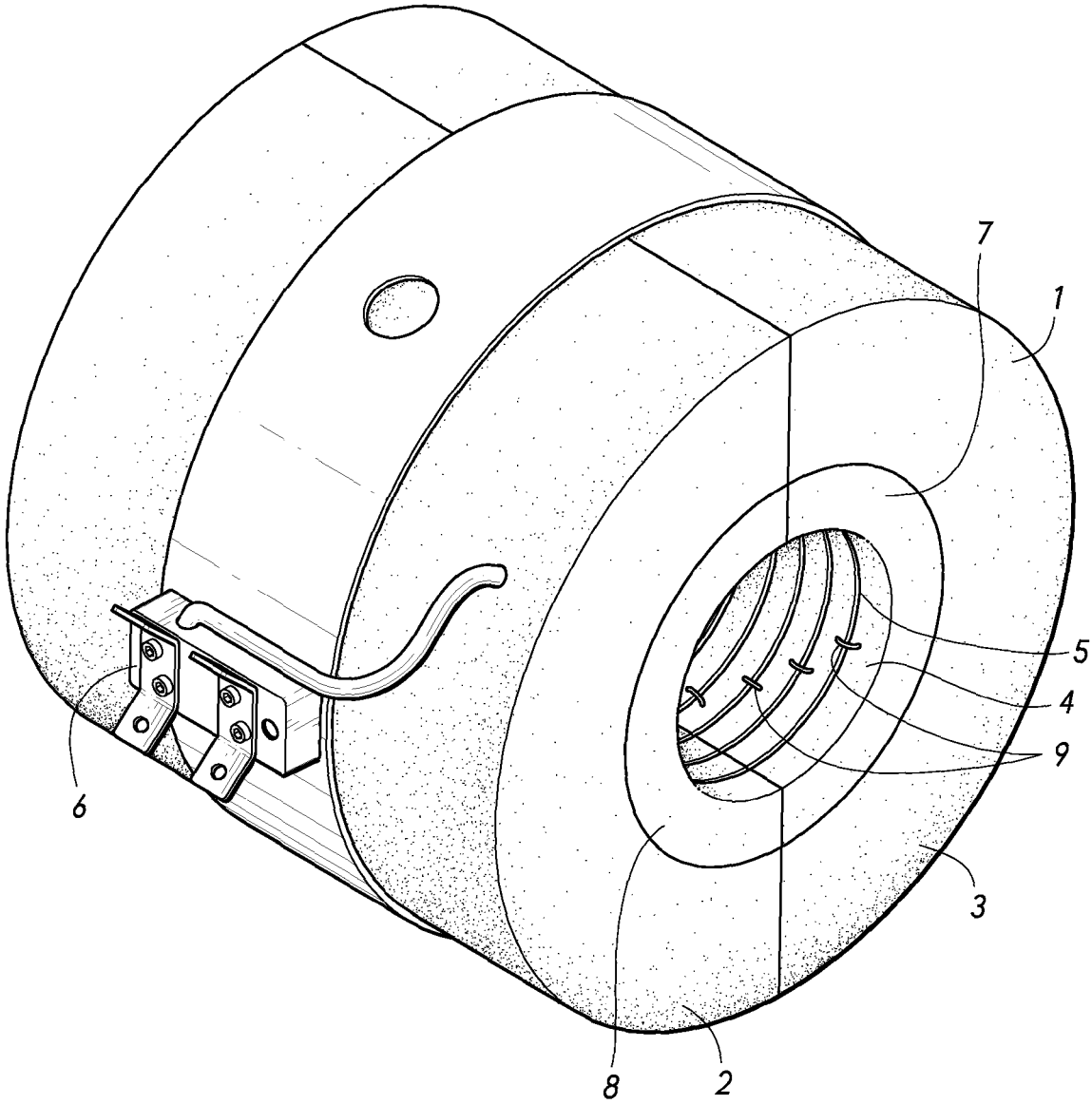

The present invention relates to a furnace insulation intended for a furnace that is heated with the aid of electrical resistance elements.

In the cases of furnaces heated to very high temperatures, high requirements are placed on the material used to insulate the volume heated in the furnace. Because the insulating material surrounds the volume heated in the furnace, the insulating material will also become very hot.

The temperature of a given type of electrically heated furnace will, under typical conditions, reach 1700° C. for a period of several hours. The insulating material used may, for instance, be comprised of insulating fibre or high grade brick.

One known problem existing in the technology applied in respect of such furnaces is that there are not many known materials that are able to withstand these high temperature stresses over a period of time sufficiently long for them to be used effectively. The known materials normally shrink at high temperatures, resulting in sealing problems with regard to those furnaces in which these known materials are used.

A suitable material is one which consists essentially of aluminium oxide ($Al_2O_3$) and silicon dioxide ($SiO_2$). Although this material is effectively resistant to heat, it shrinks at high temperatures. This shrinkage increases with high temperatures. Shrinkage is due to the fact that the material sinters as it is heated. This results in the material successively shrinking over a number of hours in operation, such over 1-10 hours.

In Applicant's so-called superthal modules there are used fibre modules designed as two semi-cylindrical elements which are placed against together each other to form a cylinder that constitutes the furnace space. Each semi-cylindrical element will often comprise two layers that lie radially outwards of each other, an inner layer and an outer layer.

The inner layer consists, for instance, of vacuum-formed fibres for a maximum use temperature of 1700° C. and has a density of 400 kg/m$^3$. This inner layer may consist of 80% $Al_2O_3$ and 20% $SiO_2$. The outer layer consists, for instance, of fibres for a maximum working temperature of 1600° C. and has a density of 300 kg/m$^3$. The outer layer may consist of 50% $Al_2O_3$ and 50% $SiO_2$.

In the case of modules of the SMU-type (Superthal muffle unit) the inner layer will most often have a thickness of 25 mm and the outer layer a thickness of 75 mm. The inner layer includes on its inner surface grooves for accommodating helical electric resistance elements. In the case of an internal diameter of the inner layer of 150 and 200 mm, the position of the resistance element in the groove is secured with the aid of fasteners.

In the case of modules of the SHC-type (Superthal half cylinder) the inner layer will most often have a thickness of 75 mm and the outer layer a thickness of 25 mm. The resistance element is mounted on the insulation with the aid of fasteners.

When furnaces that include the aforesaid type of insulation are heated, the insulation will thus shrink at high temperatures. Cracks in the insulation can be observed when the furnace is switched-off. In the worst case, whole pieces of the insulation are liable to loosen.

The problem is more of an aesthetic nature in the case of furnace spaces having inner diameters in the orders of magnitude of 100-125 mm. The problem increases with larger diameters, resulting in wide cracks and deformation of the inner insulation, and also with the risk that pieces of the insulation will loosen.

The insulation thus becomes less effective due to the form ation of cracks.

One serious problem resulting from the shrinkage of the insulation is that the resistance element will tend to be pulled away owing to the fact that it is fastened to the inner surface of the insulation, as before mentioned. As the insulation shrinks cracks form which, in turn, displace different parts of the insulation relative to one another. Because the resistance element is fastened to the insulation punctilinearly, the fastening points will be displaced relative to one another, therewith subjecting the resistance element to tension stresses and bending stresses of a magnitude such as to cause the resistance element to be pulled away.

These problems are solved by means of the present invention.

The present invention thus relates to a furnace insulation comprising fibre modules that are designed as at least two cylindrical segments which are placed against one another so as to form a cylinder whose inner volume constitutes the furnace space, wherein the modules are adapted to enable an electric resistance element to lie against and be fastened to the inner surface of the cylinder, and wherein the invention is characterized in that one or more radially extending or generally radially extending openings is/are disposed on the inner part of the cylinder.

The invention will now be described in more detail, partly with reference to an exemplifying embodiment of the invention illustrated in the accompanying drawings, in which FIG. 1 is a perspective illustration of an inventive furnace and FIGS. 2-5 illustrate different embodiments of a fibre module according to the invention.

The figures illustrate SMU-type furnaces, although they are also applicable to SHC-type furnaces.

Figure 2:
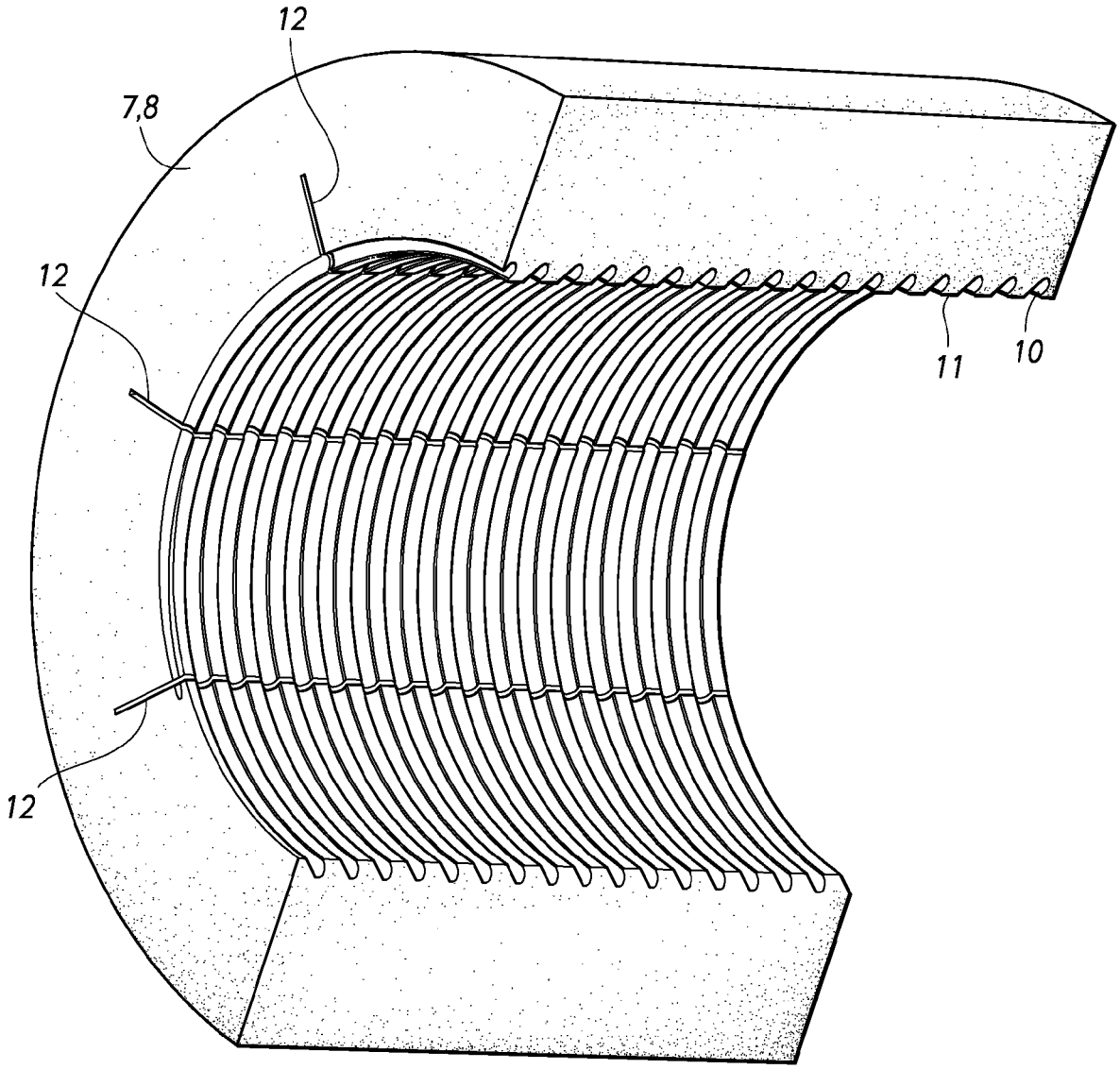

FIG. 1 illustrates a furnace 1 that includes a furnace insulation which comprises fibre modules 2, 3. The fibre modules 2, 3 are formed as semi-cylindrical elements, where one semi-cylindrical element is shown in FIG. 2. At least two semi-cylindrical elements 2, 3 are placed against each other so as to form a cylinder whose internal volume 4 constitutes the furnace space.

Only one internal fibre module is shown in FIGS. 2-5, this fibre module being intended to be placed against a further corresponding fibre module so as to form a cylinder, as illustrated in FIG. 1. Fibre modules in the form of further semi-cylindrical elements are placed on the cylinder, so as to obtain a furnace that includes two mutually concentrical layers.

The insulation is comprised generally of aluminium oxide and silicon dioxide.

The furnace includes an electric resistance element 5 which lies against and/or is fastened in the inner surface 11 of the cylinder. A power connection element 6 is also provided for delivering electric power to the resistance element.

FIG. 1 shows an embodiment in which two outer semi-cylindrical elements 2, 3 surround two mutually facing inner semi-cylindrical elements 7, 8. The resistance element may have a helical configuration or some other configuration, and is fastened in the inner surface of the cylinder by means of fasteners 9. The resistance element preferably extends in grooves 10 formed in the inside 11 of the cylinder, as shown in FIG. 2.

According to the invention, one or more radially directed openings 12 is/are provided in the inner part of the cylinder 7, 8, as shown in FIG. 2.

Figure 5:
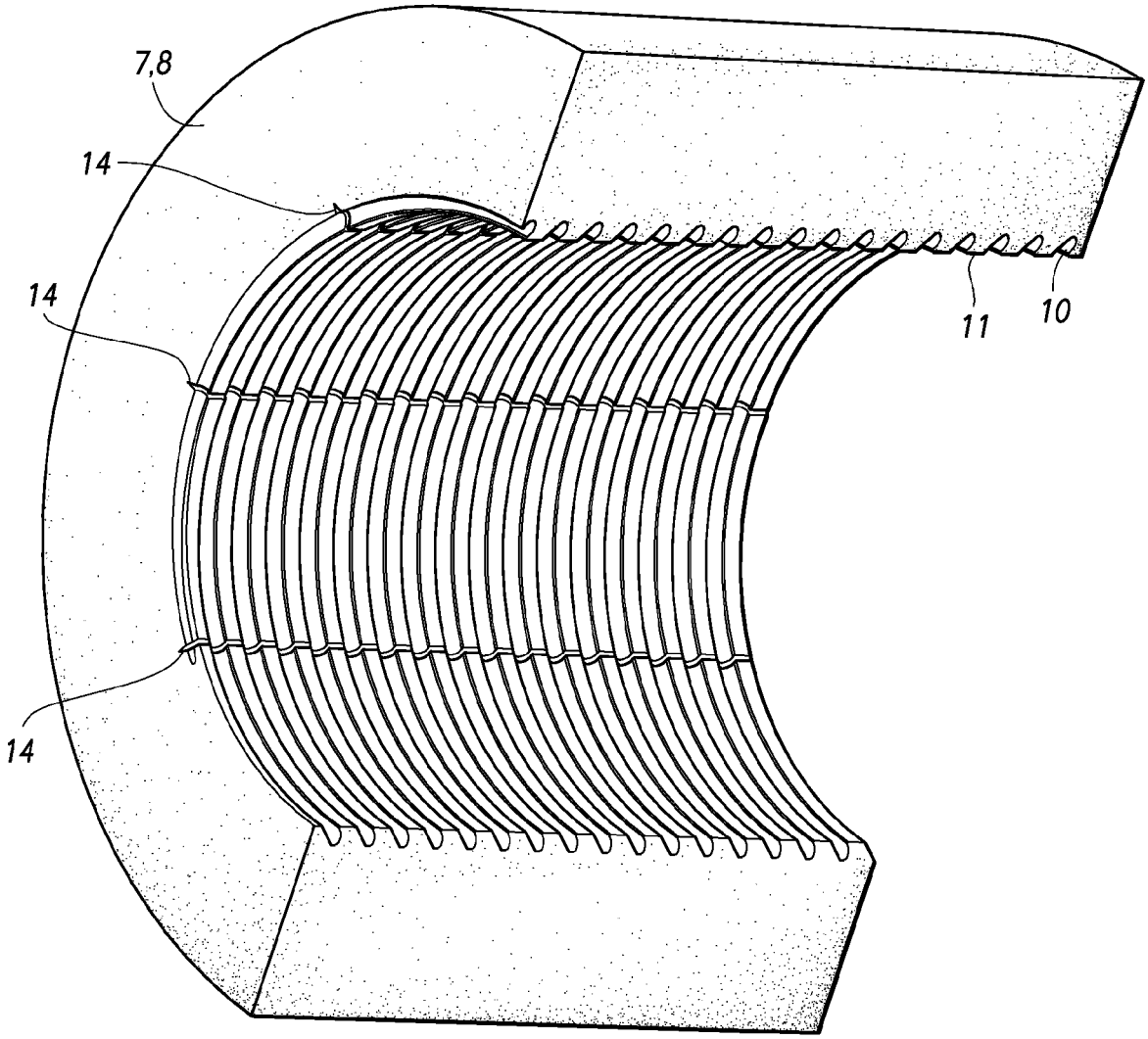

According to one preferred embodiment of the invention, the radial opening or openings may consist of a notch-like crack indicator or notch-like crack indicators 14, see FIG. 5.

Figure 4:
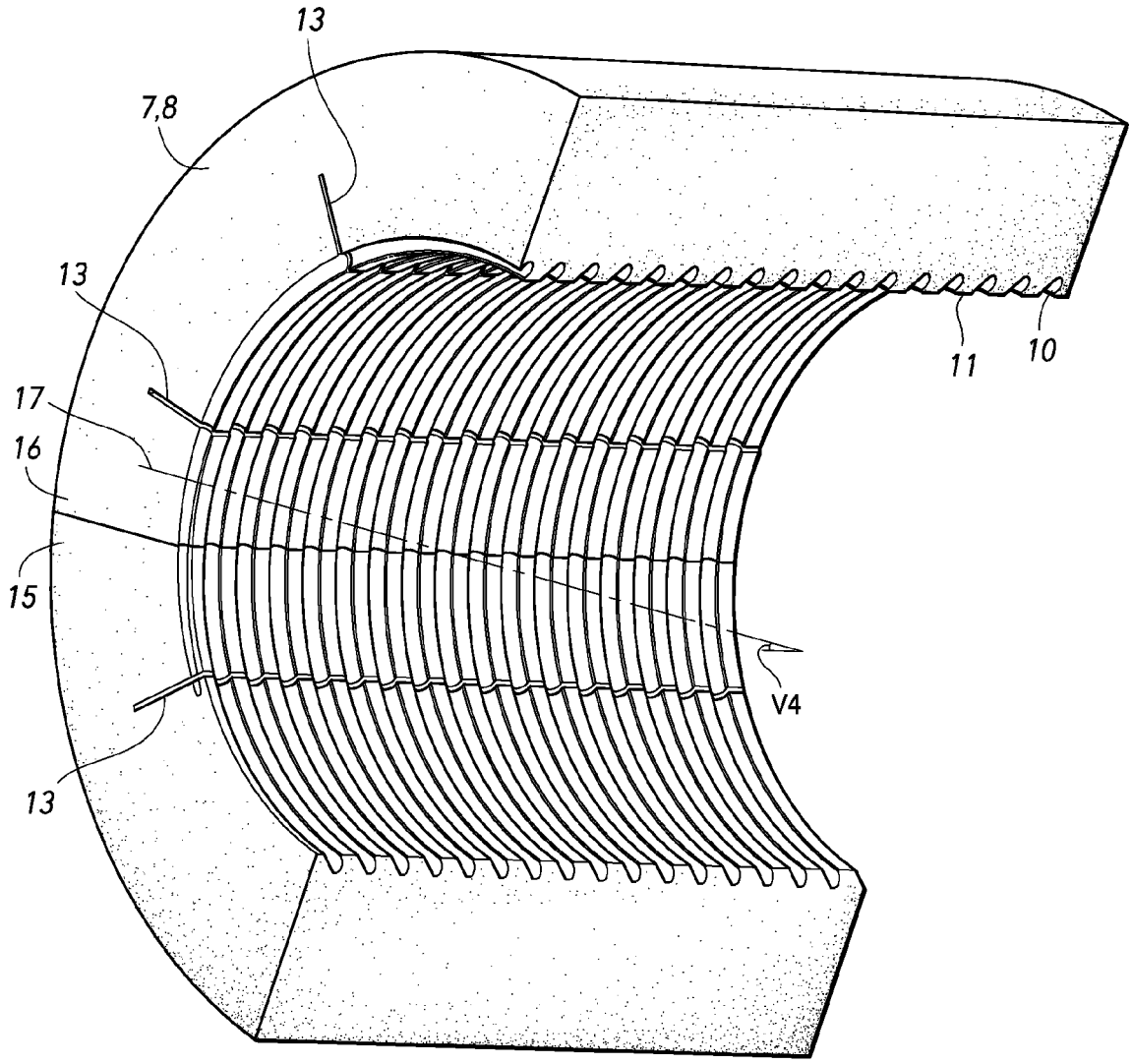

According to an alternative and preferred embodiment, the radial opening or openings consist of radially directed grooves or slots 13, as shown in FIG. 4 for instance. These grooves 13 extend down slightly into the semi-cylindrical fibre modules 2, 3, 7, 8.

The opening or openings may have other configurations, such as conical or round configurations.

In the case of the FIG. 2 embodiment, the openings 12 extend through roughly half of the inner semi-cylindrical fibre module 8.

In a preferred embodiment, the radial openings extend through roughly half the thickness of the inner layer of said mutually concentric layers.

The radial openings function as an expansion joint that contributes towards preventing the actual formation of cracks or in at least reducing crack formation. In the event of cracks forming, these cracks will form in a controlled manner due to the presence of the radial opening or openings.

In the case of SHC-furnaces, these furnaces are equipped with meandering elements, wherewith the radial openings are disposed at those positions where the meandering element bends or curves.

It is preferred that the radial opening or openings extends/extend axially along the cylinder, as shown in FIG. 2 among other figures.

According to another preferred embodiment the furnace insulation of fibre modules comprises three or more cylinder segments 15, 16 which are placed against one another so as to form a cylinder; see FIG. 4.

According to a highly preferred embodiment of the invention, the insulation includes two mutually concentrical layers 1, 2; 7, 8 of fibre modules.

It is highly essential that the openings are placed so as to be generally uniformly distributed circumferentially within each cylinder half or cylinder segment.

Figure 3:
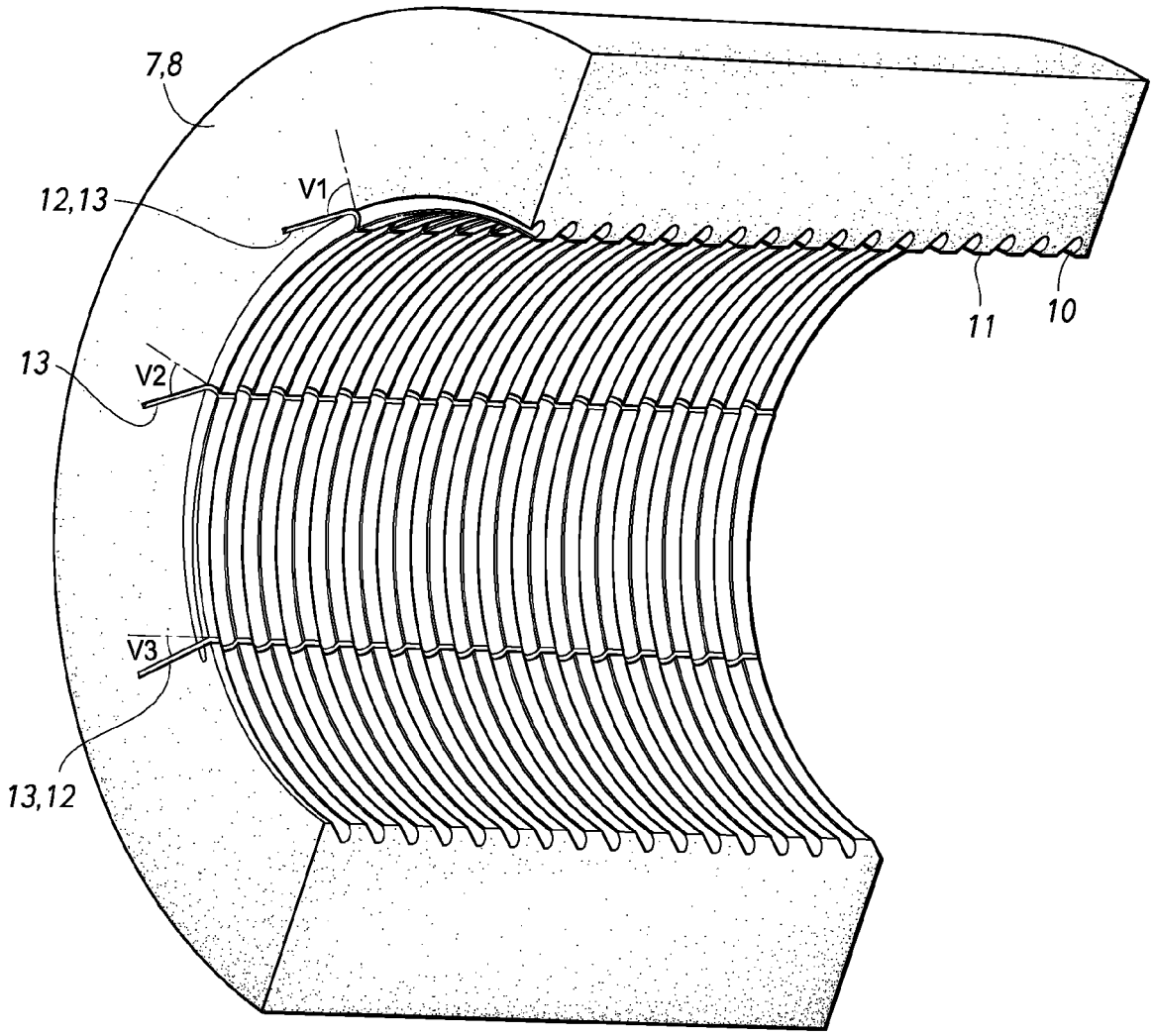

The openings 12 or the notch-like crack indicators 14 may, however, define an angle V1, V2 or V3 with the inner surface of the cylinder; see FIG. 3.

Moreover, the openings 12 or the crack indicating notches 14 may define axially an angle V4 with the longitudinal axis of the cylinder, as shown by the chain line 17 in FIG. 4.

Although the invention has been described above with reference to a number of exemplifying embodiments, it will be understood that the shape and dimensions of the furnace space can be varied and that the furnace insulation may consist of one layer or several mutually concentrical layers.

The present invention shall therefore not be considered limited to the aforedescribed embodiments, since variations can be made within the scope of the accompanying claims.

The invention claimed is:

1. A furnace insulation, comprising:

fibre modules in the form of at least two cylinder segments (2, 3; 7, 8) that are placed against one another so as to form a cylinder whose internal volume constitutes a furnace space, the fibre modules being made of a material that shrinks at high temperatures; and an electrical resistance element (5) configured to lie against and be fastened in an inner surface (4) of the cylinder, wherein an inner part of the cylinder includes one or more radially extending or generally radially extending openings (12; 14) along a length of the cylinder segments (2,3; 7, 8), and the one or more radially extending openings include at least one notch configured to be at least one crack indicator (14) and a plurality of radially extending expansion joints (12).

2. The furnace insulation according to claim 1, wherein the radially extending opening or openings are radially extending grooves (12).

3. The furnace insulation according to claim 2, wherein the radially extending opening or openings consist of radially directed grooves (12) which define with the inner surface of the cylinder an angle (V1, V2, V3) that deviates from a right angle.

4. The furnace insulation according to claim 3 wherein the radial grooves (12) extend through roughly half of the thickness of the innermost of said concentric layers (2, 3, 7, 8).

5. The furnace insulation according to claim 3, wherein the radially extending opening or openings (12; 14) extend axially along the cylinder.

6. The furnace insulation according to claim 3, wherein the furnace insulation includes three or more cylinder segments (15, 16) of fibre modules that have been placed against each other such as to form a cylinder.

7. The furnace insulation according to claim 3, wherein the insulation comprises at least two mutually concentric layers (2, 3, 7, 8) of fibre modules.

8. The furnace insulation according to claim 2, wherein the radially extending opening or openings (12; 14) extend axially along the cylinder.

9. The furnace insulation according to claim 2, wherein the furnace insulation includes three or more cylinder segments (15, 16) of fibre modules that have been placed against each other such as to form a cylinder.

10. The furnace insulation according to claim 2, wherein the insulation comprises at least two mutually concentric layers (2, 3, 7, 8) of fibre modules.

11. The furnace insulation according to claim 2, wherein the openings (12; 14) are disposed so as to be generally distributed evenly around the inner circumference of each cylinder half or cylinder segment.

12. The furnace insulation according to claim 1, wherein the radially extending opening or openings (12; 14) extend axially along the cylinder.

13. The furnace insulation according to claim 12, wherein the insulation comprises at least two mutually concentric layers (2, 3, 7, 8) of fibre modules.

14. The furnace insulation according to claim 1, wherein the furnace insulation includes three or more cylinder segments (15, 16) of fibre modules that have been placed against each other such as to form a cylinder.

15. The furnace insulation according to claim 14, wherein the insulation comprises at least two mutually concentric layers (2, 3, 7, 8) of fibre modules.

16. The furnace insulation according to claim 1, wherein the insulation comprises at least two mutually concentric layers (2, 3, 7, 8) of fibre modules.

17. The furnace insulation according to claim 16, wherein the insulation comprises at least two mutually concentric layers (2, 3, 7, 8) of fibre modules.

18. The furnace insulation according to claim 1, wherein the openings (12; 14) are disposed so as to be generally distributed evenly around the inner circumference of each cylinder half or cylinder segment.

19. The furnace insulation according to claim 1, wherein the insulation consists generally of aluminium oxide and silicon dioxide.

20. The furnace wherein it includes a furnace insulation according to claim 1 and wherein the furnace space is comprised of the internal volume of the cylinder.

* * * * *